US009394911B2

(12) United States Patent
Nakashima et al.

(10) Patent No.: US 9,394,911 B2
(45) Date of Patent: Jul. 19, 2016

(54) AXIAL FLOW FAN

(75) Inventors: Seiji Nakashima, Chiyoda-ku (JP); Koji Kise, Chiyoda-ku (JP); Hirofumi Horiuchi, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 822 days.

(21) Appl. No.: 13/643,452

(22) PCT Filed: May 13, 2010

(86) PCT No.: PCT/JP2010/003233

§ 371 (c)(1),
(2), (4) Date: Oct. 25, 2012

(87) PCT Pub. No.: WO2011/141964

PCT Pub. Date: Nov. 17, 2011

(65) Prior Publication Data

US 2013/0101420 A1 Apr. 25, 2013

(51) Int. Cl.
*F04D 19/00* (2006.01)
*F04D 29/38* (2006.01)

(52) U.S. Cl.
CPC ..... *F04D 19/002* (2013.01); *F04D 29/384* (2013.01); *F05D 2240/307* (2013.01)

(58) Field of Classification Search
CPC ..... F04D 29/38; F04D 29/384; F04D 29/386; F04D 29/661; F04D 29/663; F04D 29/666; F04D 29/68; F04D 29/681; F04D 19/002; F05D 2240/307
See application file for complete search history.

(56) References Cited

U.S. PATENT DOCUMENTS

| | | | | |
|---|---|---|---|---|
| 4,569,631 | A * | 2/1986 | Gray, III | F04D 29/386 416/169 A |
| 4,930,990 | A | 6/1990 | Brackett | |
| 5,393,199 | A | 2/1995 | Alizadeh | |
| 6,254,342 | B1 | 7/2001 | Fujinaka et al. | |
| 2005/0053493 | A1 | 3/2005 | Chung et al. | |

FOREIGN PATENT DOCUMENTS

| | | | |
|---|---|---|---|
| EP | 0 583 091 | A2 | 2/1994 |
| EP | 1 512 918 | A2 | 3/2005 |
| JP | 6 229398 | | 8/1994 |
| JP | 2008 255966 | | 10/2008 |
| JP | 2008255966 | A * | 10/2008 |

OTHER PUBLICATIONS

International Search Report Issued Jul. 20, 2010 in PCT/JP10/03233 Filed May 13, 2010.
Chinese Office Action issued Oct. 21, 2014, in Chinese Patent Application No. 201080066750.9 (with English translation).

(Continued)

*Primary Examiner* — Dwayne J White
*Assistant Examiner* — Juan G Flores
(74) *Attorney, Agent, or Firm* — Oblon, McClelland, Maier & Neustadt, L.L.P

(57) ABSTRACT

An axial flow fan, with which effective work of blades is ensured and blade tip vortices are suppressed, thereby reducing noise. The axial flow fan includes blades, which are each formed such that a chord centerline connecting chord center points from inner to outer peripheral ends of the blade is curved so as to protrude toward a downstream side in a whole region.

3 Claims, 4 Drawing Sheets

(56) References Cited

OTHER PUBLICATIONS

Extended European Search Report issued Mar. 16, 2015 in Patent Application No. 10851350.8.

Office Action issued May 15, 2015 in Chinese Patent Application No. 201080066750.9 (with English translation and English translation of Category of Cited Documents).

* cited by examiner

AXIAL FLOW FAN

TECHNICAL FIELD

The present invention relates to axial flow fans applicable to a wide range of devices such as, for example, air-conditioning devices and ventilation devices.

BACKGROUND ART

Axial flow fans are used in a wide range of air-conditioning devices, ventilation devices, and the like, and reduction of noise of the axial flow fan is demanded. There have been proposed a variety of axial flow fans devised to reduce noise. As such an axial flow fan, there is one disclosed in which "an axial flow fan comprising a plurality of blades disposed at an outer periphery of a cylindrical boss portion, wherein a shape of each of the blades is defined such that, in any portion of a section of the blade along a given plane radially extending from a rotation centerline through a blade root portion contacting the boss portion, the blade is bent toward an outer peripheral portion side, the outer peripheral portion of the blade is directed in an air sending direction, and a horizontal angle of the blade gradually increases as the blade extends toward the outer peripheral portion side" (for example, see Patent Literature 1).

In the axial flow fan described in Patent Literature 1, in addition to the above-described structure, each blade is formed as a swept-forward wing, and a swept-forward angle formed between a line connecting the rotation centerline and the midpoint of the blade root portion and a line connecting the rotation centerline and the midpoint of an outer peripheral edge of the blade is set to an angle in a range from 20° to 40°, thereby reducing noise.

CITATION LIST

Patent Literature

Patent Literature 1: Japanese Unexamined Patent Application Publication No. 6-229398 (page 5, FIG. 1, etc.)

SUMMARY OF INVENTION

Technical Problem

However, according to such a technique described in Patent Literature 1, since the shape of each blade is defined such that the horizontal angle of the blade gradually increases as the blade extends toward the outer peripheral portion side, air flows that move toward an inner peripheral side of the fan are caused to interfere with one another, thereby generating turbulence and increasing noise. Also according to such a technique described in Patent Literature 1, the pressure difference between a pressure surface and a suction surface is increased near the outer peripheral portion of the blade. Thus, a large and unstable blade tip vortex is generated, and accordingly, noise is increased.

The invention is made for solving the problem described above. An object of the invention is to provide an axial flow fan with which effective work of each blade is ensured and a blade tip vortex is suppressed, thereby reducing noise.

Solution to Problem

An axial flow fan according to the invention includes a boss that rotates about a shaft center and a plurality of blades disposed in an outer peripheral portion of the boss. In the axial flow fan, the blades are each formed such that a chord centerline connecting chord center points from an inner peripheral end of the blade to an outer peripheral end of the blade is curved so as to protrude toward a downstream side of an air flow in a whole region of the blade in a radial direction.

Advantageous Effects of Invention

With the axial flow fan according to the invention, effective work can be ensured by forming flows that move toward the inner peripheral side while turbulence due to interference of air flows with one another and enlargement and destabilization of the blade tip vortex can be suppressed. Thus, noise can be reduced.

DESCRIPTION OF EMBODIMENTS

Embodiment of the invention will be described below with reference to the drawings.

Figure 1:
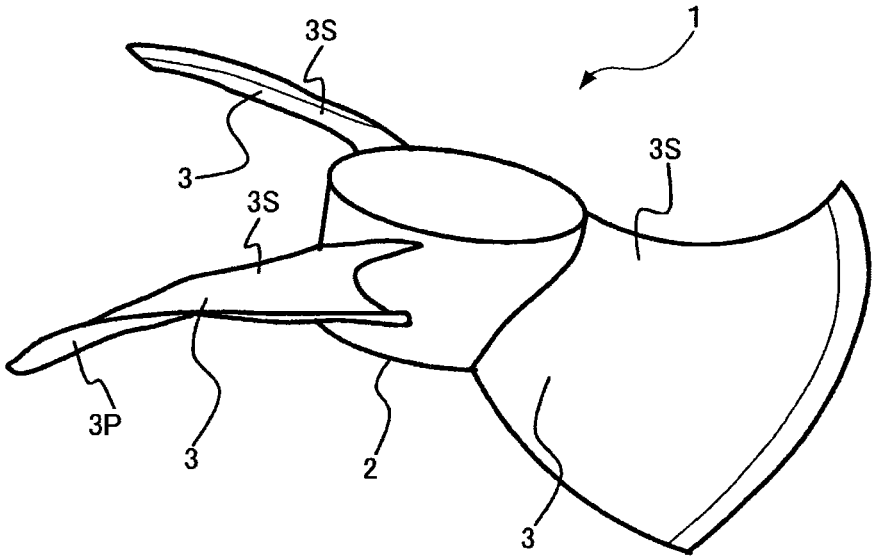
FIG. 1 is a perspective view illustrating the structure of an axial flow fan according to Embodiment of the invention.
Figure 2:
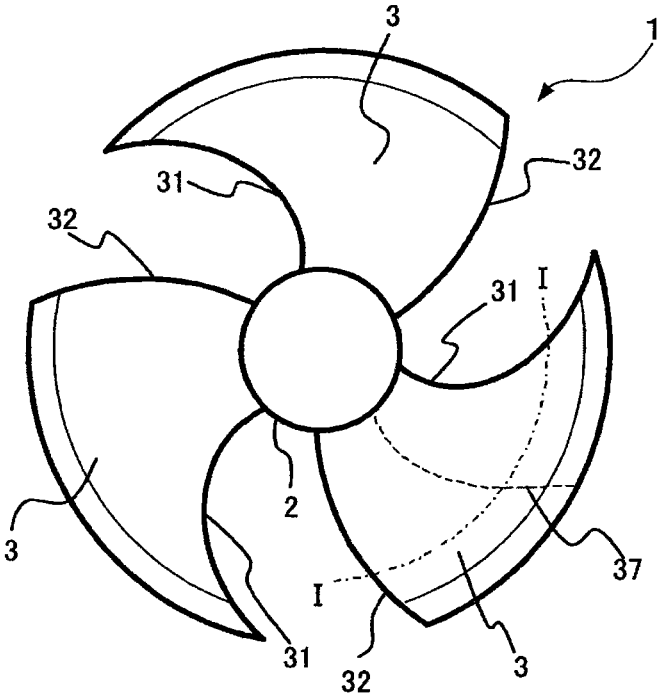
FIG. 2 is a front view illustrating the structure of the axial flow fan according to Embodiment of the invention.
Figure 3:
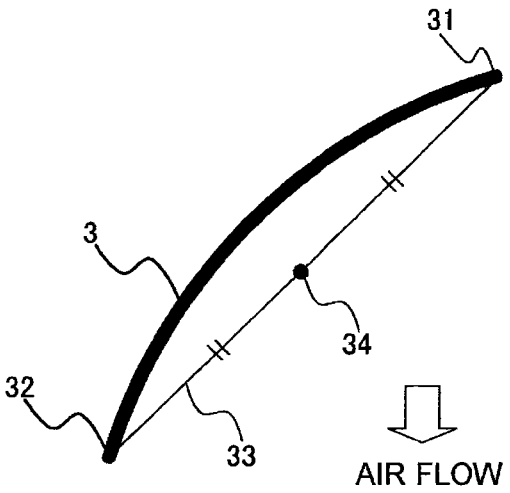
FIG. 3 is a plan development view illustrating an I-I section of FIG. 2.
Figure 4:
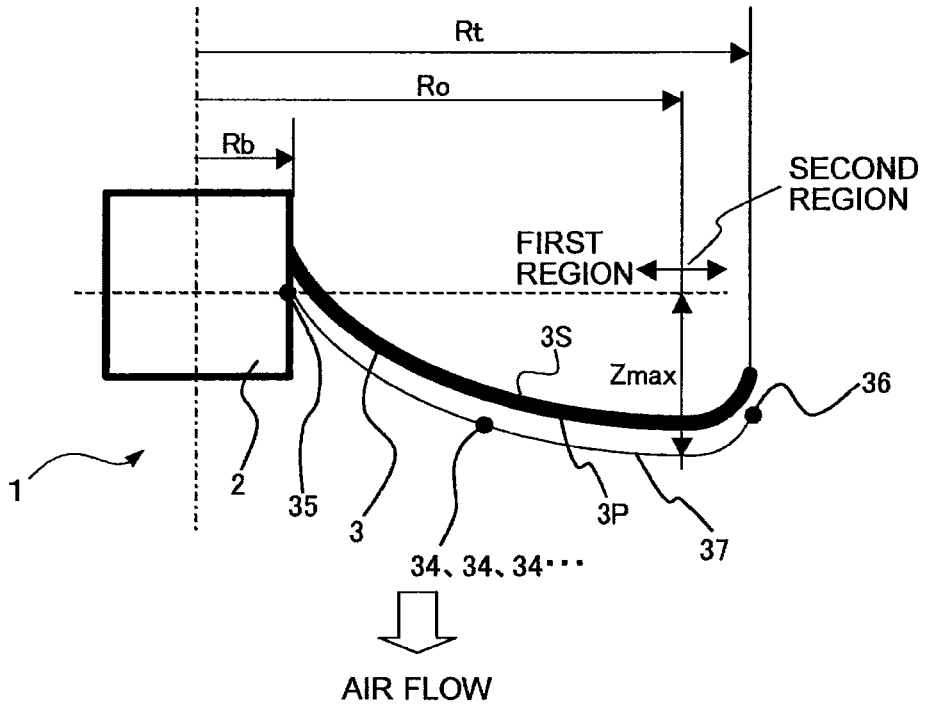
FIG. 4 is a projection view, in which a chord centerline and a blade section, which is taken along a curved plane along a rotation axis including the chord centerline, of the axial flow fan according to Embodiment of the invention are projected onto a flat plane including the rotation axis.
Figure 5:
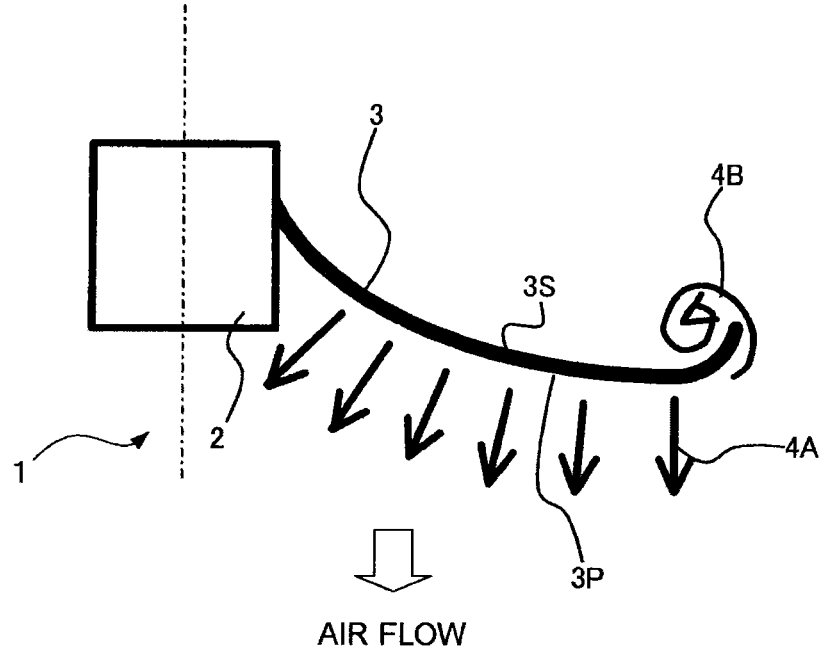
FIG. 5 includes explanatory views illustrating a flow field of the axial flow fan according to Embodiment of the invention.
Figure 5:
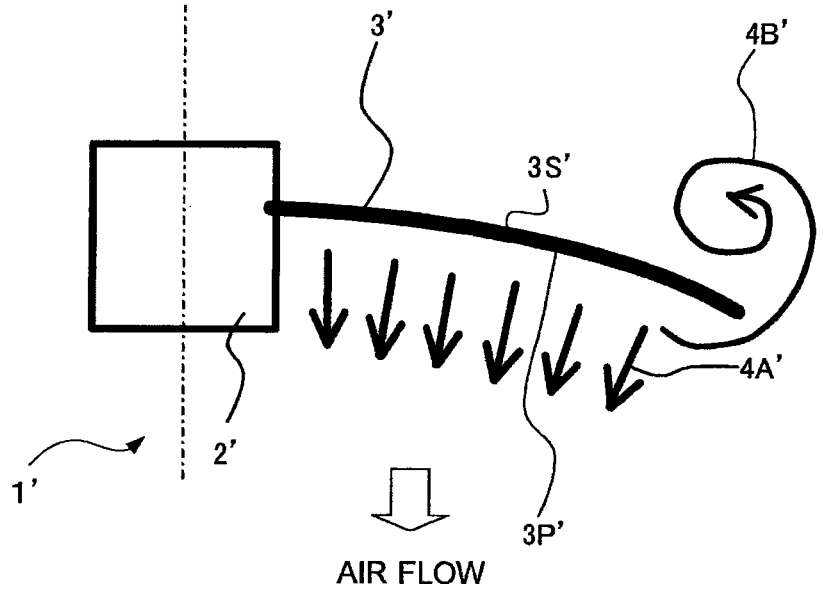
Figure 6:
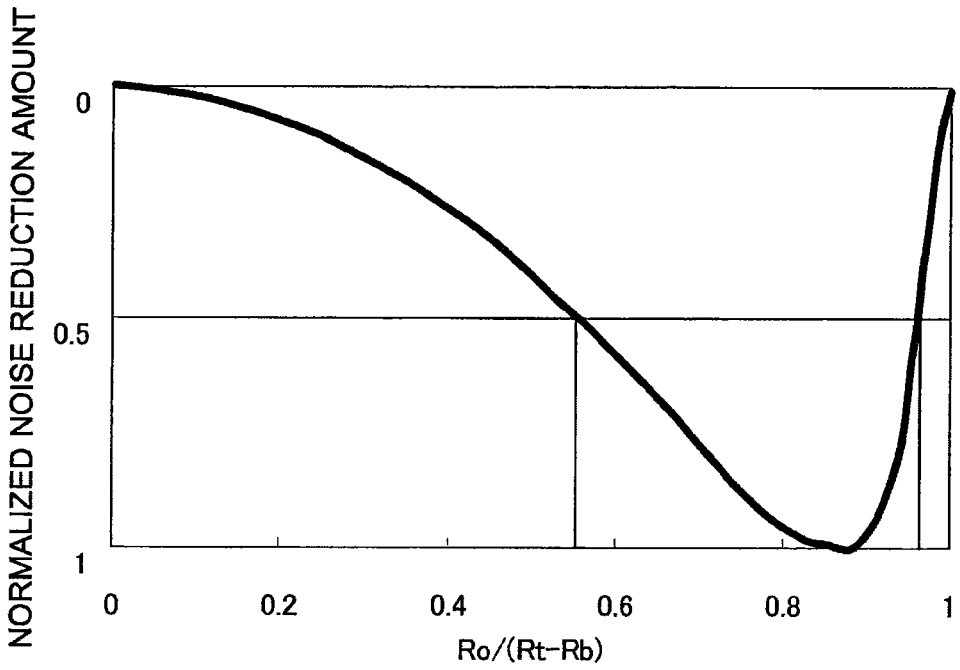
FIG. 6 is a graph illustrating the relationship between a normalized noise reduction amount and Ro/(Rt−Rb) of the axial flow fan according to Embodiment of the invention.
Figure 7:
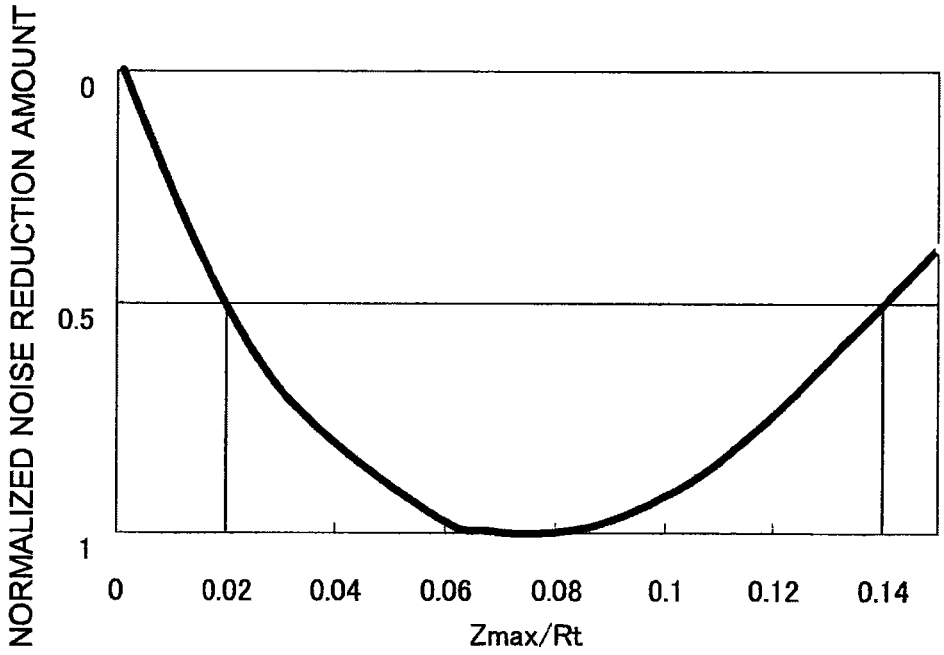
FIG. 7 is a graph illustrating the relationship between the normalized noise reduction amount and Zmax/Rt of the axial flow fan according to Embodiment of the invention.

FIG. 1 is a perspective view illustrating the structure of an axial flow fan according to Embodiment. FIG. 2 is a front view illustrating the structure of the axial flow fan according to Embodiment. FIG. 3 is a plan development view illustrating an I-I section of FIG. 2. FIG. 4 is a projection view, in which a chord centerline and a blade section, which is taken along a curved plane along a rotation axis including the chord centerline, of the axial flow fan according to Embodiment of the invention are projected onto a flat plane including the rotation axis. FIG. 5 includes explanatory views illustrating a flow field of the axial flow fan according to Embodiment. FIG. 6 is a graph illustrating the relationship between the normalized noise reduction amount and Ro/(Rt−Rb) of the axial flow fan according to Embodiment. FIG. 7 is a graph illustrating the relationship between the normalized noise reduction amount and Zmax/Rt of the axial flow fan according to Embodiment.

The axial flow fan according to Embodiment will be described with reference to FIGS. 1 to 7. The axial flow fan according to Embodiment is applicable to a wide range of devices such as, for example, an air-conditioning device and a ventilation device, and has a function of applying pressure so as to send air. In the following drawings including FIG. 1, the dimensional relationships among the components may differ from the actual dimensional relationships among the components. Also in the following drawings including FIG. 1, the same or equivalent components are denoted by the same reference signs, and this is applicable throughout the description. Furthermore, forms of elements described throughout the description are only exemplary. The forms of the elements are not limited to the description herein. For example, although an example of the axial flow fan having three blades is illustrated in the drawings in Embodiment, this does not limit the number of blades.

As illustrated in FIGS. 1 to 4, the axial flow fan according to Embodiment includes an impeller 1 having a boss 2, which rotates about a shaft center, and a plurality of blades 3, which are disposed at an outer periphery of the boss 2. That is, the blades 3 each having a three-dimensional spatial shape are attached to the outer periphery of the cylindrical boss 2 so as to extend in radial directions. The boss 2 is rotated by a motor (not shown). Rotation of the blades 3 generates air flows. As illustrated in FIG. 1, a surface on an upstream side of each blade 3 is a suction surface 3S and a surface on a downstream side thereof is a pressure surface 3P.

As illustrated in FIG. 3, a chord line 33 is defined as a line connecting a leading edge 31 and a trailing edge 32 of each blade 3 in a flat plane, which is a developed plane of a cylindrical section centering around the rotation axis of the impeller 1 (for example, the I-I section of FIG. 2). A midpoint of the chord line 33 is defined as a chord center point 34. As illustrated in FIGS. 2 and 4, a chord centerline 37 is defined as a curved line connecting the chord center points 34 of each radius from an inner-peripheral-end chord center point 35 to an outer-peripheral-end chord center point 36.

As illustrated in FIG. 4, when Ro is determined so as to satisfy Rb<Ro<Rt, a region on an inner peripheral side of the radius Ro is defined as a first region, and a region on an outer peripheral side is defined as a second region. That is, the chord centerline 37 between the inner peripheral end and the outer peripheral end of each blade 3 is divided into the first region and the second region. Here, Ro represents a radius of a boundary between the first region and the second region, Rb represents a radius of the boss 2, and Rt represents a radius of the outer periphery of the blade 3. In this case, in the first region, the chord centerline 37 is defined as a curve that is directed toward the downstream side as it extends toward the outer peripheral side and that protrudes toward the downstream side. In the second region, the chord centerline 37 is defined as a curve that is directed toward the upstream side as it extends toward the outer peripheral side and that protrudes toward the downstream side.

Advantages obtained due to the above-described structure will be described with reference to FIG. 5. FIG. 5(*a*) illustrates the flow field of the impeller 1 that is the axial flow fan according to Embodiment, and FIG. 5(*b*) illustrates the flow field of an impeller 1' that is an axial flow fan of the related art. Arrows in FIG. 5 indicate air flows (arrows 4A and arrows 4B) generated by motions of impellers (impeller 1 and impeller 1').

As illustrated in FIG. 5, in the first region, each chord centerline 37 of the impeller 1 is curved so as to be directed toward the downstream side as it extends toward the outer peripheral side, and, thus, the air flows are directed toward the inner peripheral side, ensuring effective work of each blade 3. This increases the pressure difference between the pressure surface 3P and the suction surface 3S, and accordingly, may create a large and destabilized blade tip vortex 4B, which is stirred up from the pressure surface 3P to the suction surface 3S at an outer peripheral end portion of the blade 3. However, as illustrated in FIG. 5(*a*), in the second region, the chord centerline 37 of the impeller 1 is curved so as to be directed toward the upstream side as it extends toward the outer peripheral side. Thus, the pressure difference is relieved in a local portion near an outer peripheral portion of the blade 3, and enlargement and destabilization of the blade tip vortex 4B can be suppressed.

In contrast, as shown in FIG. 5(*b*), in the impeller 1' of the related art, blades 3' attached to a boss 2' each have a shape in which a horizontal angle of the blade 3' gradually increases as the blade 3' extends toward an outer peripheral portion side, and, thus, the pressure difference between a pressure surface 3P' and a suction surface 3S' increases near an outer peripheral portion of the blade 3' making the blade tip vortex 4B' large and unstable. This causes noise to be increased. Also with the impeller 1' of the related art, as illustrated in FIG. 5(*b*), air flows 4A' directed toward an inner peripheral side interfere with one another, thereby generating turbulence and increasing noise.

That is, with the axial flow fan according to Embodiment, each chord centerline 37 is, in the first region, curved so as to be directed toward the downstream side as it extends toward the outer peripheral side, and in the second region, the chord centerline 37 is curved so as to be directed toward the upstream side as it extends toward the outer peripheral side. Thus, a synergistic effect is produced, thereby ensuring effective work of the blade 3 and suppressing the blade tip vortex. Accordingly, the axial flow fan according to Embodiment is capable of reducing noise by ensuring effective work of the blades 3 and by suppressing blade tip vortices.

As illustrated in FIG. 5(*a*), in the impeller 1, each chord centerline 37 is, in the first region, curved so as to protrude toward the downstream side, and, thus, the air flows 4A pushed out of the pressure surface 3P are released to the downstream side in a dispersed manner. As a result, turbulence generated by the air flows interfering with one another can be reduced, and accordingly, noise can be further reduced. Furthermore, as illustrated in FIG. 5(*a*), in the impeller 1, since each chord centerline 37 is also curved in the second region so as to protrude toward the downstream side, the shape of each blade 3 matches the locus of the blade tip vortex 4B, and accordingly, generation of turbulence can be reduced and noise can be further reduced.

Here, the relationship between Ro/(Rb−Rt) and a noise reduction amount is described with reference to FIG. 6. In FIG. 6, the vertical axis represents a normalized noise reduction amount and the horizontal axis represents Ro/(Rb−Rt). Here, the noise reduction amount indicates the amount of noise after reduction with the axial flow fan according to Embodiment relative to that of, for example, an axial flow fan with which Ro/(Rb−Rt) is 0 or 1 as is the case with the axial flow fan of the related art. The noise reduction amount is expressed as a normalized noise reduction amount, which is a normalized value where the difference between a noise level of the axial flow fan of the related art and a noise level of the axial flow fan according to Embodiment obtained under a condition of Ro/(Rb−Rt) that minimizes its noise is set to 1. Thus, in FIG. 6, a positive value indicates that the noise level of the axial flow fan according to Embodiment is smaller than that of the axial flow fan of the related art.

In FIG. 6, the normalized noise reduction amount becomes greater than 0.5 in a range where 0.55<Ro/(Rt−Rb)<0.96 is satisfied; it can be understood that an effect of reducing noise is seen more markedly. In the first region, as the value of Ro/(Rt−Rb) increases, the range of the curve, which is directed toward the downstream side as the chord centerline 37 extends toward the outer peripheral side, formed by the chord centerline 37 increases. This increases the amount of air flow directed toward the inner peripheral side, and accordingly, effective work is more easily ensured. In the second region, as the value of Ro/(Rt−Rb) decreases, the pressure difference near the outer peripheral portion of the blade 3 can be more smoothly relieved, thereby allowing enlargement and destabilization of the blade tip vortex to be effectively suppressed. Thus, by setting the range of the value of Ro so as to satisfy $0.55<Ro/(Rt-Rb)<0.96$, both the effects described above can be exerted in a most balanced manner. As a result, noise can be further reduced.

Next, the relationship between Zmax/Rt and the noise reduction amount is described with reference to FIG. 7. In FIG. 7, the vertical axis represents a normalized noise reduction amount and the horizontal axis represents Zmax/Rt. Here, Zmax represents, as illustrated in FIG. 4, the maximum value of a distance in a perpendicular direction between the chord centerline 37 and a reference horizontal line, which passes the inner-peripheral-end chord center point 35. The noise reduction amount indicates the amount of noise after reduction with the axial flow fan according to Embodiment relative to that of an axial flow fan, of which Zmax/Rt=0. The noise reduction amount is expressed as a normalized noise reduction amount, which is a normalized value where the difference between a noise level of the axial flow fan, of which Zmax/Rt=0, and a noise level of the axial flow fan according to Embodiment obtained under a condition of Zmax/Rt that minimizes its noise is set to 1. Thus, in FIG. 7, a positive value indicates that the noise level of the axial flow fan according to Embodiment is smaller than that of the axial flow fan of the related art.

In FIG. 7, the normalized noise reduction amount becomes greater than 0.5 in a range where $0.02<Zmax/Rt<0.14$ is satisfied, and it can be understood that the noise reduction effect is seen more markedly. When Zmax/Rt is increased, inclination in the first region of the chord centerline 37, which is directed toward the downstream side as the chord centerline 37 extends toward the outer peripheral side, is increased. Although the air flows are effectively directed toward the inner peripheral side, air sending capacity in the axial direction tends to decrease. Thus, by setting Zmax/Rt in the above-described range, the air flows can be most effectively directed toward the inner peripheral side and effective work can be ensured while the air sending capacity in the axial direction is maintained. Thus, noise can be further reduced.

Desirably, the shapes of the leading edge 31 and the trailing edge 32 are defined such that the leading edge 31 and the trailing edge 32 are also curved, in the first region, so as to be directed toward the downstream side as they extend toward the outer peripheral side and so as to protrude toward the downstream side; and, in the second region, curved so as to be directed toward the upstream side as they extend toward the outer peripheral side and protrude toward the downstream side. Such shapes can further contribute to the noise reduction effect. However, it is sufficient that the shapes of the leading edge 31 and the trailing edge 32 be defined in accordance with purposes for which the axial flow fan is used. The shapes of the leading edge 31 and the trailing edge 32 are not limited.

REFERENCE SIGNS LIST

1 impeller, 1' impeller, 2 boss, 2' boss, 3 blade, 3' blade, 3P pressure surface, 3P' pressure surface, 3S suction surface, 3S' suction surface, 4A air flow, 4A' air flow, 4B blade tip vortex, 4B' blade tip vortex, 31 leading edge, 32 trailing edge, 33 chord line, 34 chord center point, 35 inner-peripheral-end chord center point, 36 outer-peripheral-end chord center point, 37 chord centerline, Rb radius of boss, Ro radius of boundary, Rt radius of outer periphery of blade, and Zmax maximum value of distance in perpendicular direction between chord centerline and reference horizontal line passing chord center point at inner peripheral end.

The invention claimed is:

1. An axial comprising:

a boss that rotates about a shaft center; and a plurality of blades disposed in an outer peripheral portion of the boss, wherein a chord line is defined as a line connecting a leading edge and a trailing edge of each blade, a center point of the chord line is defined as a chord center point, a chord centerline is defined as a curved line connecting the chord center points of each radius from an inner-peripheral-end chord center point to an outer-peripheral-end chord center point, wherein the blades are each formed such that the chord centerline is curved so as to protrude toward a downstream side of an air flow a whole region of the blade in a radial direction relative to a surface perpendicular to the shaft center of the inner-peripheral-end chord center point, wherein the chord centerline of each blade is divided into a first region and a second region in a range of the blade from the inner peripheral end to the outer peripheral end, wherein in the first region, the blade is formed such that the chord centerline is curved so as to be directed toward the downstream side of the air flow as the chord centerline extends toward an outer peripheral side so as to protrude toward the downstream side, wherein in the second region, the blade is formed such that the chord centerline is curved so as to be directed toward an upstream side of the air flow as the chord centerline extends toward the outer peripheral side so as to protrude toward the downstream side, wherein, where Ro is a radius of a boundary between the first region and the second region, Rb is a radius of the boss, and Rt is a radius of an outer periphery of the blade, a relationship among the Ro, the Rt, and the Rb is set in a range that satisfies:

$$0.55<Ro/(Rt-Rb)<0.96.$$

2. The axial flow fan of claim 1, wherein, where Zmax is a maximum value of a distance in a perpendicular direction between the chord centerline and a reference horizontal line that passes the chord center point at the inner peripheral end and Rt is a radius of an outer periphery of the blade, the relationship between the Zmax and the Rt is set in a range that satisfies:

$$0.02<Zmax/Rt<0.14.$$

3. The axial flow fan of claim 1, wherein each of the plurality of blades includes a leading edge and a trailing edge, and wherein the leading edge is curved so as to be directed toward the downstream side of the air flow, and the trailing edge is curved so as to be directed toward an upstream side of the air flow.

* * * * *